US006991548B2

(12) United States Patent
Arie

(10) Patent No.: US 6,991,548 B2
(45) Date of Patent: Jan. 31, 2006

(54) ELEVATED WOOD AND CONCRETE RACETRACK FOR GO-KARTS AND ASSOCIATED METHODS

(76) Inventor: John Arie, 5551 Del Verde Way, Orlando, FL (US) 32819

( * ) Notice: Subject to any disclaimer, the term of this patent is extended or adjusted under 35 U.S.C. 154(b) by 0 days.

(21) Appl. No.: 10/302,778

(22) Filed: Nov. 22, 2002

(65) Prior Publication Data

US 2003/0130050 A1 Jul. 10, 2003

Related U.S. Application Data

(63) Continuation-in-part of application No. 09/861,919, filed on May 21, 2001, now Pat. No. 6,508,716, which is a continuation-in-part of application No. 09/383,771, filed on Aug. 26, 1999, now Pat. No. 6,244,968.

(51) Int. Cl.
*A63K 3/00* (2006.01)

(52) U.S. Cl. ..... 472/85; 472/88; 404/18

(58) Field of Classification Search ..... 472/85, 472/88, 89, 90; 404/17, 18, 1, 27, 28, 29, 404/31, 34, 36, 43–46
See application file for complete search history.

(56) References Cited

U.S. PATENT DOCUMENTS 1,713,793 A * 5/1929 Traver ..... 104/63
2,031,249 A * 2/1936 Bowman ..... 404/31
2,044,498 A * 6/1936 Pearce ..... 404/28
2,254,482 A * 9/1941 Heller ..... 472/90
2,742,288 A * 4/1956 Brunel ..... 472/90
3,266,800 A * 8/1966 Yee ..... 472/89
3,810,706 A * 5/1974 Grimm et al. ..... 404/1
4,531,859 A * 7/1985 Bettigole ..... 404/73
5,152,633 A * 10/1992 Mercer et al. ..... 404/82
5,645,368 A * 7/1997 Yunick ..... 404/6
5,660,595 A * 8/1997 Ferro et al. ..... 472/92

FOREIGN PATENT DOCUMENTS

FR 2592665 A * 7/1987

* cited by examiner

*Primary Examiner*—Kien Nguyen
(74) *Attorney, Agent, or Firm*—Allen, Dyer, Doppelt, Milbrath & Gilchrist, P.A.

(57) ABSTRACT

An elevated wood and concrete racetrack includes a wooden support surface having a plurality of floor boards laid flat to form at least one straightaway, and at least one banked curve, each floor board of the plurality having two lengthwise, substantially parallel, spaced apart sides. A concrete racetrack surface is overlayed on the wooden support surface, and a racetrack support frame has a plurality of vertical support posts anchored on suitable land and a plurality of support members connected thereto for supporting the wooden support surface above ground.

15 Claims, 6 Drawing Sheets

ELEVATED WOOD AND CONCRETE RACETRACK FOR GO-KARTS AND ASSOCIATED METHODS

RELATED APPLICATION

This application is a continuation-in-part of and claims priority from application Ser. No. 09/861,919 which was filed on May 21, 2001 now U.S. Pat. No. 6,508,716, and which was a continuation-in-part of application Ser. No. 09/383,771, filed on Aug. 26, 1999, now U.S. Pat. No. 6,244,968, all of which are incorporated herein by reference in their entirety.

FIELD OF THE INVENTION

The present invention relates to the field of racetracks for go-karts and, more particularly, to an elevated racetrack which may be erected over a parcel of land having a stormwater retention basin thereon.

BACKGROUND OF THE INVENTION

Go-karts and similar motorized amusement vehicles have been popular for many years. Driving a go-cart on a suitably proportioned racetrack is a fun-filled experience for the entire family, young and old. Racetracks for go-karts have been part of the amusement park industry practically since commercially available go-karts appeared on the market. Most go-cart tracks are asphalt or concrete racetracks built at ground level, much as roads for regular vehicles.

Because of the technical difficulty and expense involved in building an elevated go-cart racetrack, fewer of these tracks have been built. In addition, building an elevated racetrack using conventional techniques, such as all concrete or asphalt, greatly increases the expense of construction. Therefore, builders have turned to wood as a suitable construction material for elevated go-cart racetracks. Previous to the present invention, however, elevated wooden racetracks have been very difficult and extremely labor intensive and have been subject to undesirable deterioration due to sun and weather effects.

SUMMARY OF THE INVENTION

With the foregoing in mind, the present invention advantageously provides a go-cart racetrack including an elevated wood and concrete racetrack surface supported by a structural frame anchored to the ground below. The wood and concrete racetrack surface includes a wooden support surface having a plurality of floor boards, has a first and second outer periphery defining the outer edges of the racetrack, a concrete layer positioned above the wooden support surface, and extends along a plurality of tiers elevated above ground level. The wood and concrete racetrack surface also includes a plurality of banked curves formed from a plurality of wooden floor boards laid flat to form at least one straightaway, and at least one banked curve. Each floor board has two lengthwise, substantially parallel, spaced apart sides, so that a first floor board of the plurality abuts a second floor board of the plurality so that the two substantially parallel, spaced apart sides of the first floor board are substantially parallel to the two substantially parallel, spaced apart sides of the second floor board. A concrete overlay is positioned on the wooden support surface so as to form a racetrack surface. A racetrack support frame comprising a plurality of vertical support posts anchored on suitable land and a plurality of support members connected thereto supports the wood and concrete racetrack surface above ground. Each banked curve formed by this construction method preferably includes several sections of track having floor boards aligned in parallel. The banked curves are very quickly constructed by this technique, avoiding the need for cutting each individual floor board along a radius of the curve.

Furthermore, an additional feature of the present racetrack includes a concrete racetrack surface which is formed by pouring concrete over the wooden support surface. This concrete overlay track provides all of the advantages of a wooden track, such as ease and economy of construction, with the added strength and durability of a concrete track.

The wooden support surface is supported on a racetrack support frame having a plurality of vertical support posts positioned anchored on suitable land and connected to a plurality of support beams and support joists and stringers acting as braces positioned abuttingly underlying and connected directly or indirectly to the wooden support surface, to provide elevation above ground and structural support.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may, however, be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 3:
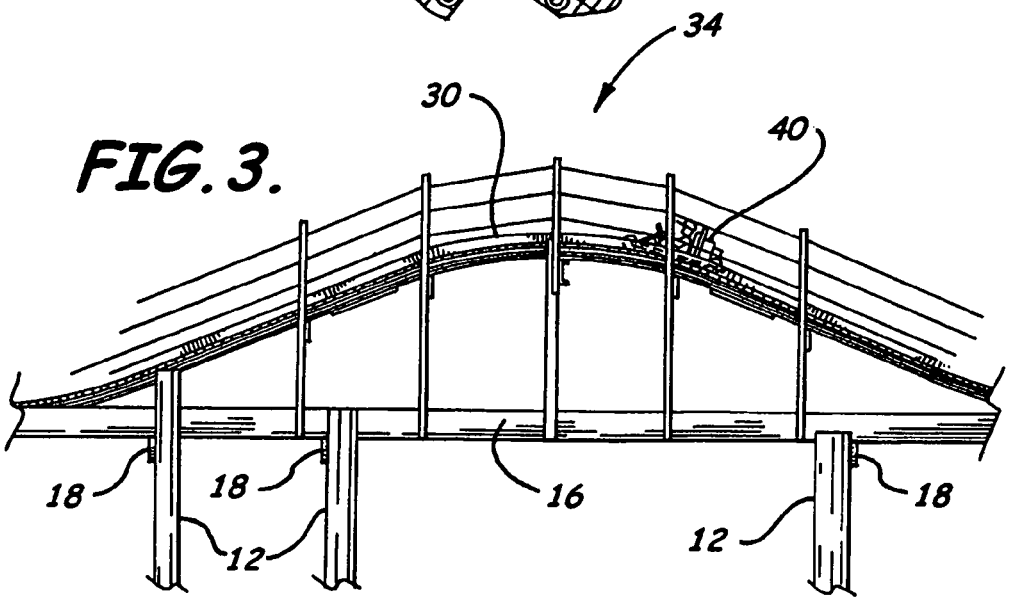
FIG. 3 is a side elevation showing an arched bridge section of the elevated wood and concrete racetrack.
Figure 4:
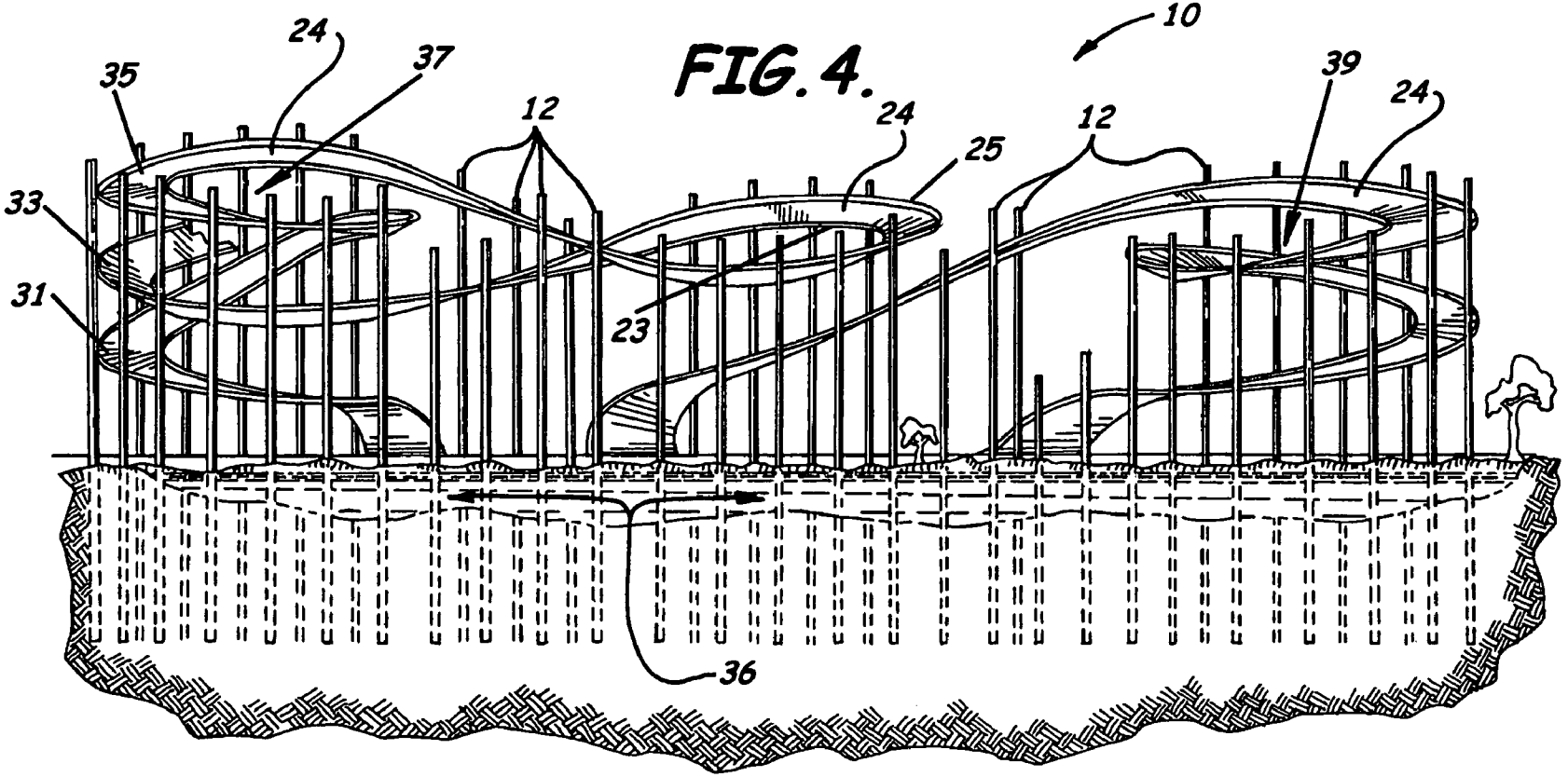
FIG. 4 is an overall side elevation illustrating the elevated wood and concrete racetrack and its support posts.
Figure 5:
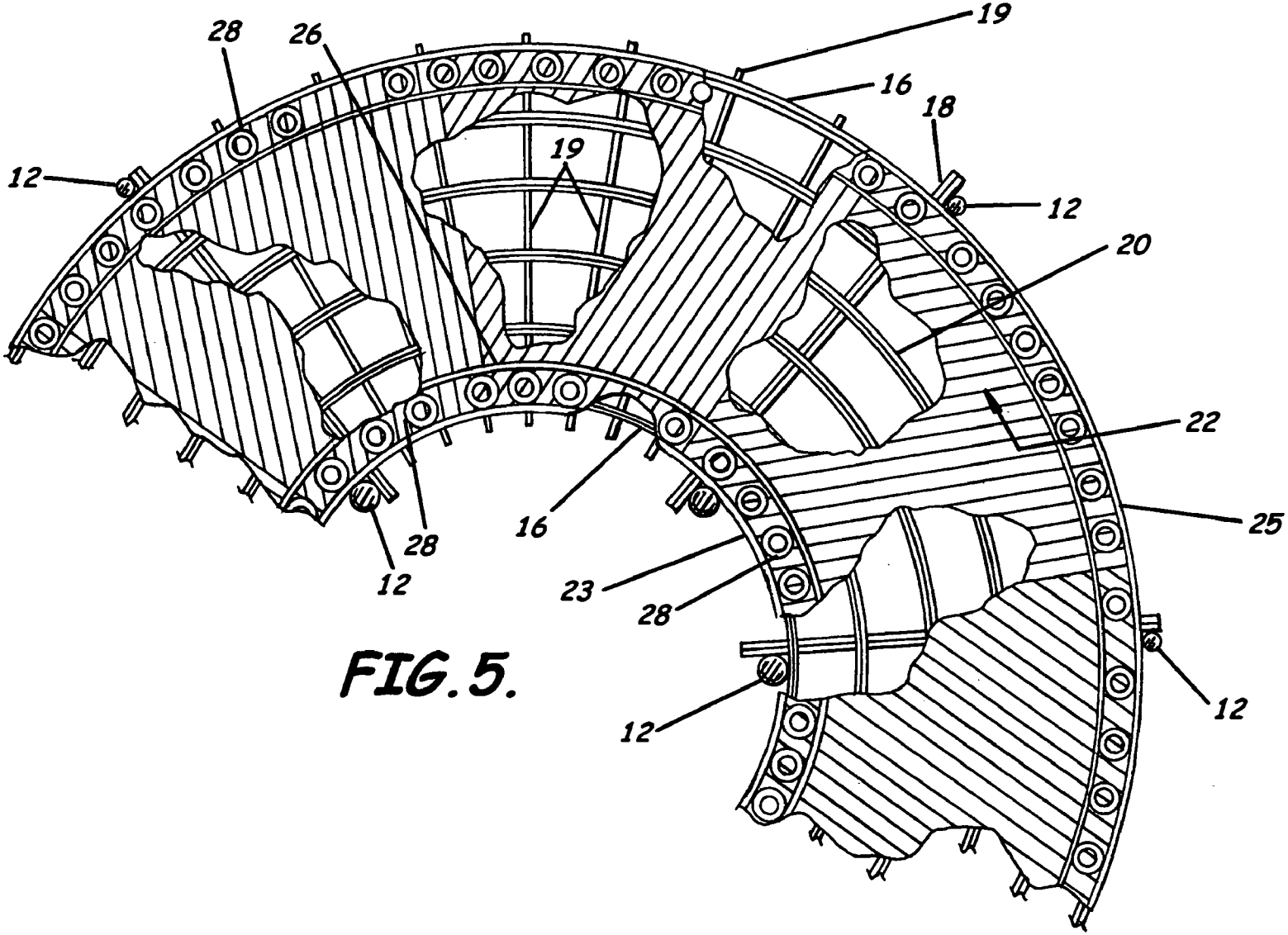
FIG. 5 is a cutaway view showing construction detail of the wooden support surface, without the concrete overlay thereon, along a banked curve according to the present invention.
Figure 6:
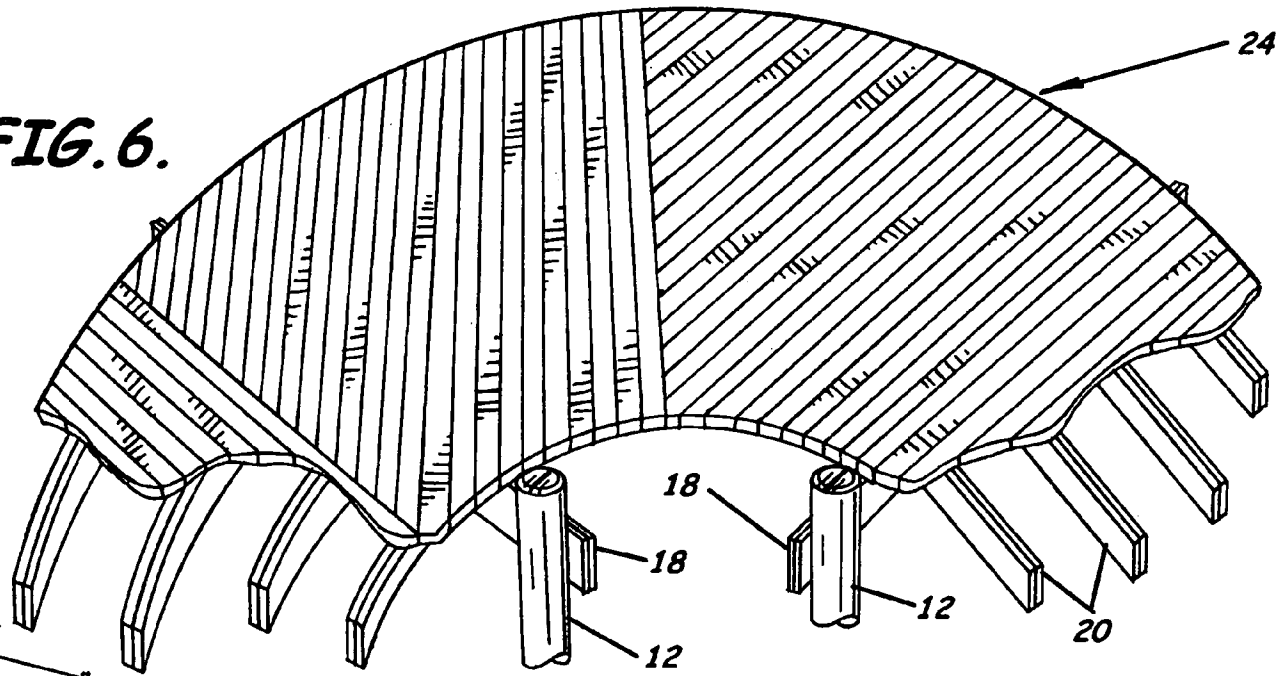
FIG. 6 illustrates the wooden support surface of a banked curve, without the concrete overlay thereon, constructed according to the present invention.

FIGS. 1 through 8 illustrate a racetrack suited for operating motorized amusement vehicles thereon. The invention includes an elevated wooden racetrack 10 positioned on a support frame having a plurality of vertical support posts 12, best shown in FIGS. 1 and 4. As used herein and known to those skilled in the art, the terms for the various members included in the support frame are intended to generally have the following meanings. Vertical support posts 12 are vertically oriented support members having one end sunk into the ground and the other end at a sufficient height to meet the design and engineering requirements for providing support for the elevated track 10. Beam supports 16 are substantially horizontal support members connected to posts 12 and serving to sustain the various beams. Beam supports 16 are preferably boards having a nominal size of two-by-twelve (2×12), but may be sized otherwise according to the needs of the project. Beams 18 are substantially horizontal support members running generally perpendicular to the track, and connected to posts 12 and/or to beam supports 16. Beams 18 may be subdivided into two categories, depending on how they are connected in the support frame. Primary beams are connected to at least two posts, generally positioned directly opposite each other along the track, as seen in FIG. 6. Primary beams are preferably made by joining a plurality of boards to form a laminated beam, also as seen in FIG. 5. Secondary beams are connected to beam support members 16, or to a post 12 and a beam support member 16. Beams 18 are generally members having a nominal size of two-by-twelve (2×12), but may be of other sizes required by the construction. Joists are generally horizontal support members running substantially parallel to the track and abuttingly connected to beams, preferably through the use of joist hangers, as known in the art. Stringers are generally horizontal support members running parallel to the track but which, unlike joists, are connected to beams by being positioned on top of the beams, usually standing on edge. Joists and stringers 20 are substantially equivalent support members and may be used essentially interchangeably.

Joists and stringers are generally either two-by-six (2×6) or two-by-twelve (2×12), but other sizes may be employed as well. Stringers 20 are shown in FIG. 6 as laminated support members made up of two two-by-six (2×6) boards. Preferably, stringers 20 are laminated by joining together anywhere from two to four boards, the boards being one-by-four (1×4), two-by-eight (2×8), or any other desired size which provides sufficient flexibility for making bends to support the curved track surface.

The posts 12, in a preferred embodiment, are substantially similar to wooden telephone poles. The vertical support posts 12 may be stabilized by any method known to those skilled in the art, and are preferably sunk into the ground to a depth sufficient to provide sufficient stability for the support frame. The posts 12 may be also further stabilized by being connected to the ground or to each other by supporting cables. As known to those skilled in the art, the posts may be further stabilized by being set in concrete, rock gravel, and the like. The vertical support posts 12 are connected to a plurality of support members, as variously shown in FIGS. 5, 6 and 7.

Figure 7:
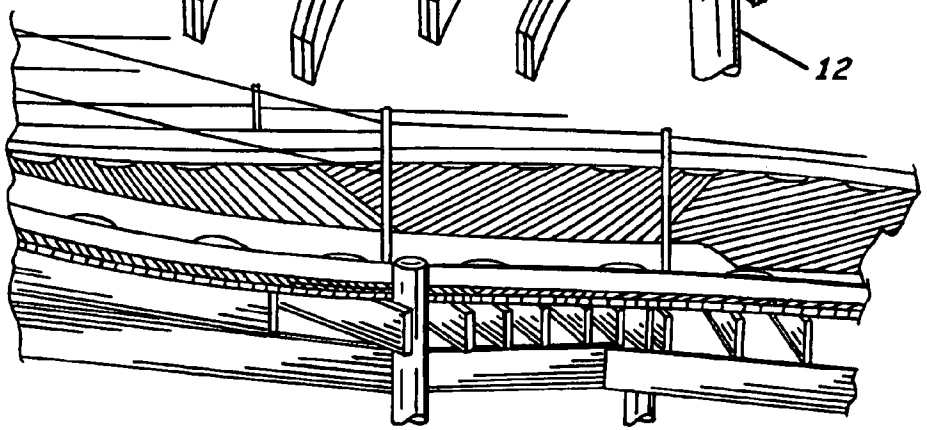
FIG. 7 is a side perspective view showing construction detail of the elevated wood and concrete racetrack.

The support beams 18 and support joists 20 may be positioned abuttingly underlying and directly or indirectly connected to the wooden support surface 22, as best shown in FIG. 7, thereby providing elevation above ground and structural support for the wooden support surface 22. The whole assembly of vertical support posts 12, beams 18, joists 20 and stringers forms an interconnected network of support members which collectively make up the racetrack support frame.

The racetrack includes a wooden support surface 22, best seen in FIGS. 1, 2, 5 and 6, connected to and supported by the racetrack support frame. The wooden support surface 22 has a first and second outer periphery, forming the edges of the track surface, and extends along a plurality of tiers elevated above ground level, creating the multi-level racetrack surface 22 shown in FIGS. 1 and 4.

In addition, the wooden support surface 22 includes a plurality of banked curves 24, at times forming spirals, as illustrated in FIG. 4. Each banked curve 24 defines at least part of the circumference of an imaginary circle having a predetermined center. The first outer periphery of the banked curve 24 is positioned toward the center of the imaginary circle so as to define an inside curve periphery. The second outer periphery of each banked curve 24 is positioned toward the circumference of the imaginary circle so as to define an outside curve periphery for the curve.

Figure 2:
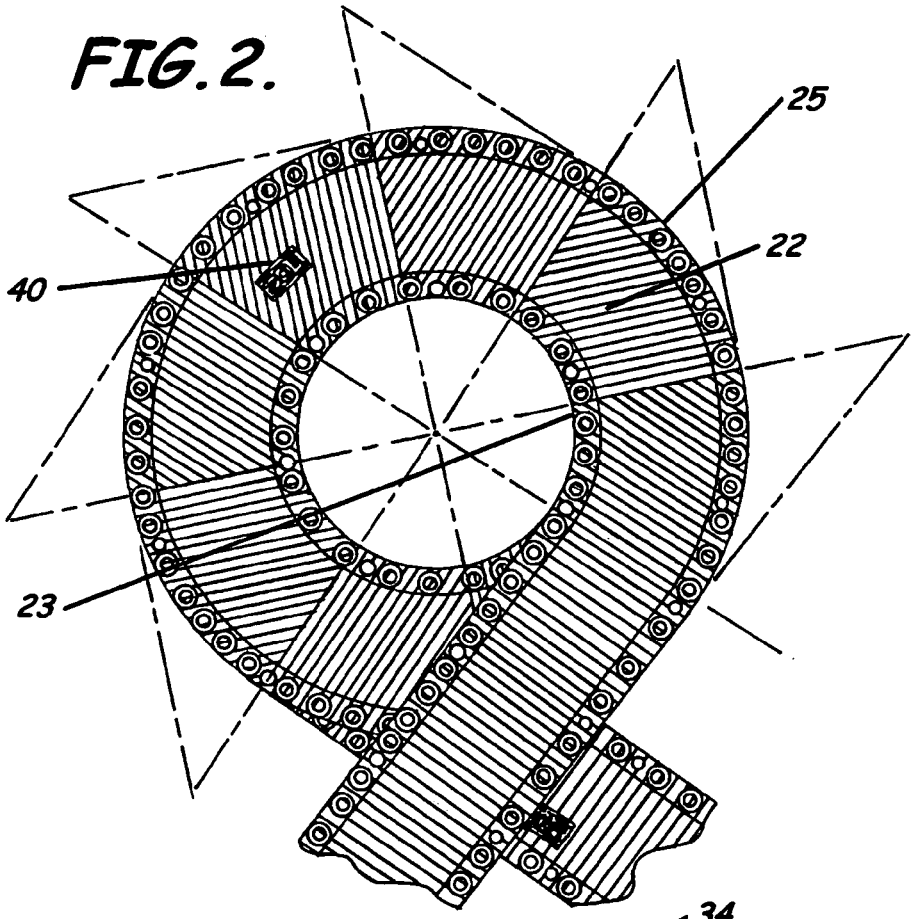
FIG. 2 is a top plan view of the wooden support surface, without the concrete overlay thereon, of a three-level spiral curve built according to the present invention.

The racetrack surface 22 includes a plurality of floor boards laid flat to form at least one straightaway, and at least one banked curve. When used in the construction, each floor board is substantially rectangular, having two lengthwise, substantially parallel, spaced apart sides. Laid flat to form the racetrack surface 22, a first floor board of the plurality abuts a second floor board of the plurality so that the two substantially parallel, spaced apart sides of the first floor board are substantially parallel to the two substantially parallel, spaced apart sides of the second floor board, as shown in FIGS. 2, 5 and 6. As the floor boards are laid parallel to each other from a straightaway to a curve, shown in FIG. 2, the lineup of boards will not follow the curve, but will run off the side of the curve. A single cut is then made along a radius of the curve, and a new set of floor boards is then laid parallel to the cut, to result in the curve surface shown in FIGS. 2, 5 and 6. This construction method is much simpler, and faster than the prior art method requiring that each individual floor board forming the curve be cut into a pie shape along the radius of the curve in order for the boards to fit together into the curve.

A racetrack support frame comprising a plurality of vertical support posts anchored on suitable land and a plurality of support members connected thereto supports the wooden support surface above ground. Each banked curve 24 formed by this construction method will include several sections of track having floor boards aligned in parallel, as best shown in FIGS. 2, 5 and 6. The banked curves are very quickly constructed by this technique, avoiding the need for cutting each individual floor board along a radius of the curve, as seen in the conventional curve construction shown in FIG. 2.

Figure 1:
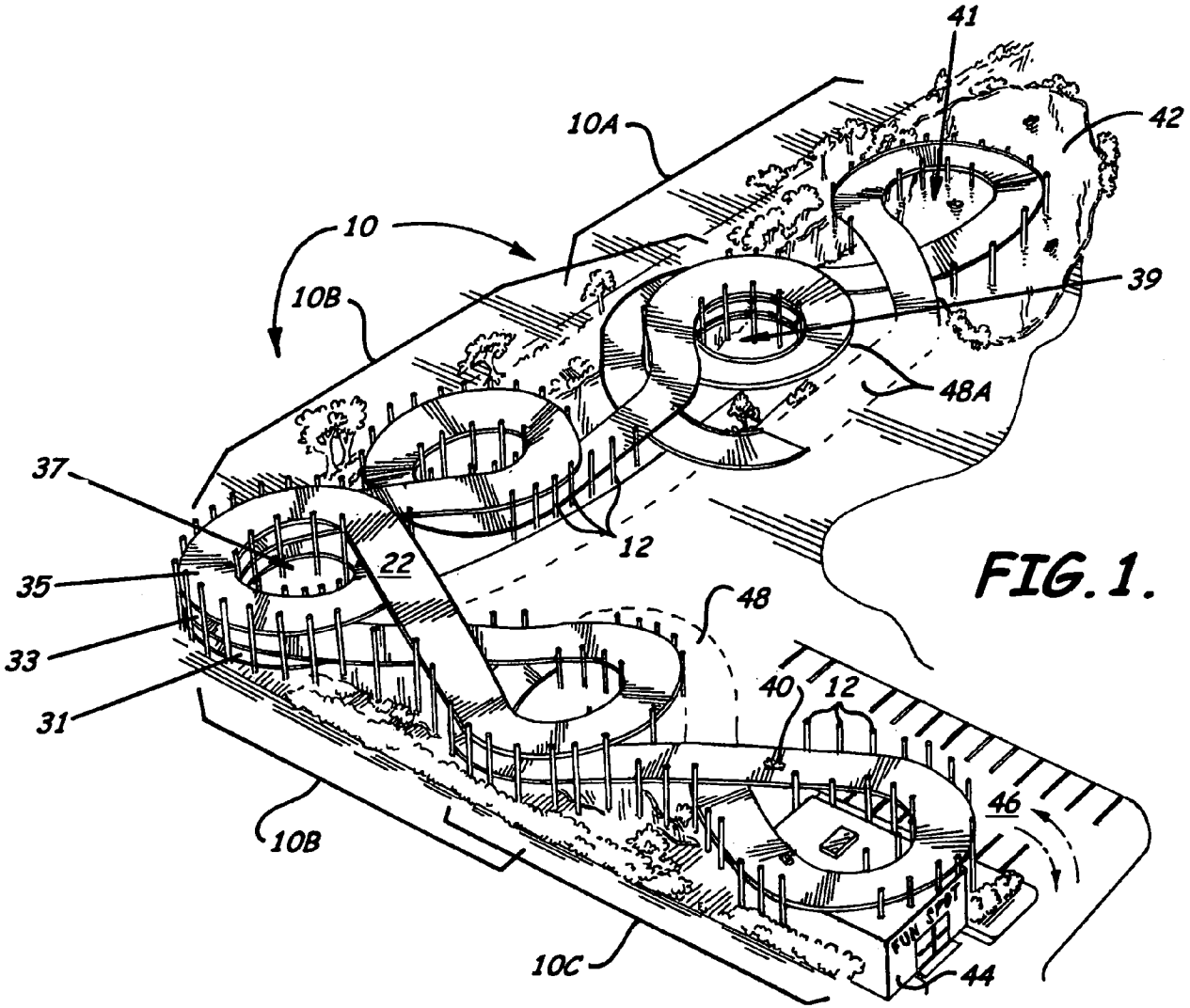
FIG. 1 is an overall perspective view of the elevated wood and concrete racetrack according to an embodiment of the present invention.

Each banked curve may be banked at a predetermined angle varying from approximately 10 to 45 degrees of inclination, depending on the design of the racetrack. The banks are constructed by angling the support beams 18 and support joists 20, shown in FIGS. 5 and 6, to create the desired angle in the banked curve 24. The plurality of banked curves 24 may be combined with straightaway sections of racetrack to create turns, ovals, figure eights, multi-level spirals, or any other desired shape, as generally shown in FIG. 1.

Several further aspects of a preferred embodiment of the invention will now be described with reference to the accompanying figures. First, it will be apparent to those skilled in the art that a preferred wood for building the present invention is pressure treated timber or other weather resistant wood. The vertical support posts 12, in particular, must be resistant to deterioration brought about by ground contact, including wood destroying organisms such as termites. The motorized amusement vehicles are preferably go-karts 40 positioned to operate on the racetrack, as illustrated in FIGS. 2 and 3. The racetrack also preferably includes a shock absorbing guard rail 26 positioned along at least one outer periphery of the wooden support surface 22, thereby to absorb the shock of an impact produced by one of the motorized amusement vehicles. The shock absorbing guard rail 26 may include tires 28 as a resilient, shock absorbing material, best shown in FIGS. 2, 3 and 6. In a preferred embodiment the tires 28 are old discarded tires from small aircraft, which can be obtained inexpensively, are particularly strong, and have a relatively small diameter, thus taking up less space along the edge of the racetrack surface 22. The tires 28 are provided with drainage holes drilled through whichever side of the tire will face down on the racetrack, thereby helping prevent accumulation of rain water within the tire cavity. The shock absorbing guard rail 26 may be low, resembling a curb as shown in FIGS. 6 and 7, or may be taller depending on preference or the characteristics of the particular racetrack. In addition, the racetrack preferably includes a safety fence 30 positioned along the first and second outer peripheries, or sides of the wooden support surface 22. The safety fence 30 preferably includes a plurality of safety wires 32 connected to the vertical support posts 12 and positioned along the first and second outer peripheries of the wooden support surface 22, thereby serving as a retaining safety fence 30 to prevent the motorized amusement vehicles from accidentally leaving the wooden support surface 22. Such a safety fence 30 is best shown in side elevation in FIG. 3, and an alternative embodiment is shown in FIG. 7.

The racetrack surface 22 may have other topographical features to provide a variable terrain tending to promote amusement in the operator of the vehicle. For example, the wooden support surface 22 may preferably include at least one arched bridge 34 section positioned to form an overpass above at least another portion of the wooden support surface 22, a feature shown in FIG. 3. Vehicle operators passing the arched bridge 34 will experience an exhilarating sensation similar to that produced when cresting a hill on a highway, including the slight pull of gravity forces on the way up the hill and the sudden drop in gravity at reaching and passing the crest. A wooden arched bridge 34 is very difficult to build using conventional techniques to create a smooth and even transition up to the crest of the bridge and down thereafter. A feature of the invention particularly useful for construction of such bridges is a laminated support beam including a plurality of wooden boards connected to each other so as to form the laminated support beam. The laminated support beam is positioned connected to and underlying the wooden support surface 22 creating the bridge, thereby providing very strong structural support. Advantageously, the plurality of wooden boards making up this laminated beam is staggered in position relative to each other, so as to create a support beam having a hump along one edge, thereby providing an underlying support structure for the arched bridge which allows the wooden support surface 22 to be smooth and fully supported at the crest of the arch.

The present invention also includes an associated method preferably including three steps, as follows. First, providing a wooden support surface 22 having a first and second outer periphery, the wooden support surface 22 extending along a plurality of tiers elevated above ground level and having a plurality of banked curves 24, each banked curve defining at least part of a circumference of an, imaginary circle having a predetermined center, the first outer periphery of the banked curve positioned toward the center so as to define an inside curve periphery, and the second outer periphery of the banked curve 24 positioned toward the circumference so as to define an outside curve periphery, each banked curve including a plurality of wooden slats positioned vertically on edge and abuttingly adjoining at least one other wooden slat of said plurality, the plurality of wooden slats positioned bent into shape and at a predetermined angle of inclination from the inside curve periphery to the outside curve periphery, thereby to define the banked curve 24, the wooden support surface 22 useful for racing motorized amusement vehicles thereon. Secondly, providing a racetrack support frame including a plurality of vertical support posts 12 positioned anchored on suitable land and connected to a plurality of support beams 18 and support joists 20, the support beams 18 and support joists 20 positioned abuttingly underlying and connected to the wooden support surface 22, thereby to provide elevation above ground and structural support. Then, providing at least one motorized amusement vehicle positioned on the racetrack, the vehicle having a driver positioned for operating the vehicle. A preferred motorized amusement vehicle for carrying on this method is a go-cart, as known to those skilled in the art.

Additionally, great commercial utility for this invention is found in a method of producing revenue from land having a stormwater retention basin thereon, by constructing and operating a motorized amusement vehicle ride above the stormwater retention basin or pond 36, as shown in FIG. 4, or an amusement water ride such as bumper boats 42, as shown in FIG. 1. The invention embodied in this method allows production of revenue from this otherwise unproductive parcel of land.

Environmental regulations are such that stormwater retention ponds are usually required for commercial building projects, to help prevent direct discharge of pollutants into local streams and lakes. The project developer is thus faced with having to reserve part of the available land for use as the stormwater retention pond, which completely restricts the use of that land, decreasing available revenue from the property. A working installation of this invention has obtained required environmental permits and is successfully operating directly over such a stormwater retention basin, thereby creating additional income for the owner of the property. The method includes the steps of providing at least one motorized amusement vehicle positioned on a racetrack erected above the stormwater retention basin, the racetrack sufficiently elevated above ground level such that the stormwater retention basin operates substantially within design characteristics, and allowing drivers to operate the motorized amusement vehicle for a fee, thereby producing revenue. This arrangement is best illustrated in FIGS. 1 and 4. This method, potentially, could be employed anywhere there is a stormwater retention basin on commercially zoned property and would be a particularly attractive addition to a mall or large shopping center.

As best shown in FIG. 1, the amusement park of the present invention includes another park facility constructed and operated under an elevated portion of the racetrack. The other park facility could include an amusement ride 42, a building 44, and a parking lot 46. For example, a boat ride 42 requiring a pool of water can be operated under an elevated portion of the racetrack, as shown on the right side of FIG. 1. The boat ride preferably provides bumper boats as known in the trade. A building 44 is shown constructed in the space below an elevated portion of the racetrack 10.

In the combination, the other park facility constructed and operated under an elevated portion of the racetrack could be a second racetrack, separate from but intertwined with the first racetrack. The park facility located under an elevated portion of the racetrack could also be a pit area 48 where customers begin and end the go-kart ride. The pit area 48 may be shared with an adjacent second racetrack separate from the elevated wooden racetrack, the second racetrack being at ground level or also comprising elevated portions. As can be appreciated by careful examination of FIG. 1, three separate but adjacent and intertwined tracks 10A, 10B and 10C are shown. Racetracks 10A and 10B share pit area 48A.

The entrance to the park may preferably include a building 44 constructed at least partially on land below an elevated portion of the racetrack, thereby saving space on the parcel of land. A building constructed below an elevated portion of the racetrack may also be positioned elsewhere in the park and have a variety of other uses related to the park's operation. For example, a building 44 underlying the racetrack 10 would be an ideal location for a game arcade drawing customers finishing their go-kart ride. A retail store for souvenirs, or a food concession would be additional possible operations located in the building under the racetrack. For example, a retail shop could have a racing theme associated with the go-kart track and sell auto racing novelties, memorabilia, and other related items. Additionally, the amusement park's entrance could be constructed and operated under an elevated portion of the racetrack. Such an arrangement would catch the public's attention, serving substantially as an advertisement for the amusement park, and tending to draw more customers into the park.

One particularly advantageous embodiment of the invention includes a parking lot 46 constructed at least partially on land below an elevated portion of the racetrack 10C, a feature shown in FIG. 1. As previously noted, parcels of land sufficiently large for an amusement park are difficult to find in urban areas. These parcels are also usually very expensive, therefore, it is important to construct the amusement park to efficiently use the available space, thereby producing as much income as possible per unit area.

An added feature of the present racetrack includes a concrete racetrack surface 50 which is formed by pouring concrete mix over the wooden support surface 22. This concrete overlay track provides all of the advantages of a wooden track, such as ease and economy of construction, with the added strength and durability of a concrete track. The concrete overlay track may be built in the same manner as described above, with the concrete overlay added after finishing the wooden construction portion of the project. The concrete overlay process is equally adaptable to refurbishing of an old, existing wooden track which may have somewhat deteriorated due to the effects of sun and weather.

Figure 8:
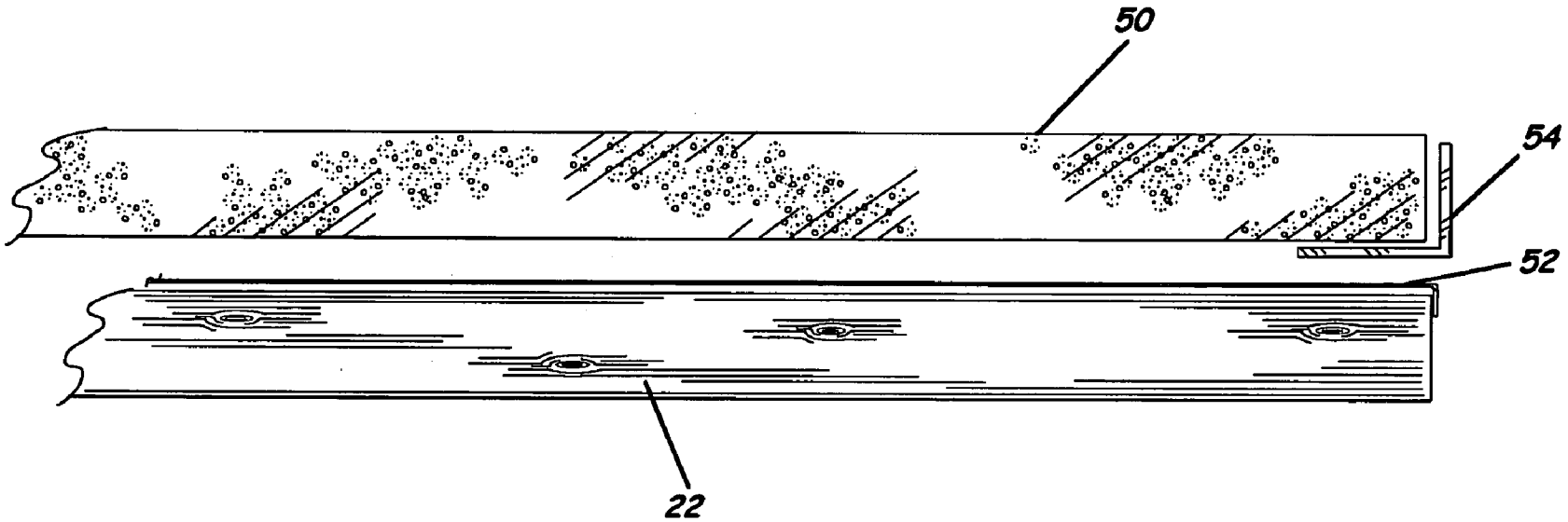
FIG. 8 shows an exploded cross sectional view of the wood and concrete racetrack of the present invention.

In constructing the wood and concrete elevated track combination, the process is similar for new or old tracks to be resurfaced, with some minor exceptions. Before overlaying concrete on an old and weatherbeaten wooden track, it is necessary to first refasten all loose boards, and perhaps even replace any portion of the track surface which may be heavily worn. Guardrails must be removed to allow easy access to the wooden track surface. The wooden track surface is preferably relatively clean and free from oil and the like. An elastomeric membrane 52 is applied over the wooden support surface 22, the membrane preferably being at least 60 mil in thickness. Following application of the membrane, metal angle members 54 are applied to the track edges so as to secure the edges of the membrane to the track. As shown in FIG. 8, the angle members 54 are positioned so that, rather than having one side of the angle downwardly aligned along the side edge of the track, the angle extends upwardly from the track surface to form a containment edge to hold the concrete. The angle members 54 are preferably at least 2 in. by 2 in. galvanized ⅛ in. steel or other weather resistant material of similar strength, but may be any size and strength suitable for the particular project. A layer of light weight concrete approximately 2 in. thick is poured over the wooden support surface, preferably having welded wire, rebar, or other suitable additive material included for strengthening the concrete layer. In addition, the concrete may also include a material effective in enhancing the resiliency of the concrete, so as to aid in preventing cracking of the concrete layer. Such materials, for example, include glass fibers and rubber chips such as obtained from ground rubber tires. The layer of concrete may be any thickness effective for its purpose, however, the skilled will recognize that a thicker layer will be more resistant to cracking, but will also be heavier and require stronger support. The poured concrete overlay is bull floated and troweled for leveling, as known in the concrete arts, and then gently brushed to a textured finish so as to provide improved traction along the track surface.

The present invention also includes other method aspects, in addition to the concrete overlay process described above, including a method for generating revenue by operating a motorized amusement vehicle track in an airspace over a parcel of land used for another purpose different from the operation of the motorized amusement vehicle track. The method includes installing a plurality of vertical support posts about at least a peripheral portion of the parcel of land, the support posts extending into the airspace a sufficient vertical distance to support a plurality of tiers of a racetrack, fixing a racetrack for the motorized amusement vehicles to the vertical support posts along a plurality of tiers into the airspace above the level of the parcel of land, constructing the plurality of tiers of the racetrack in the airspace above the parcel of land with multiple levels of generally concentric circles defined by banked racetrack curves, each circle having a predetermined center with an axis of all the centers extending through the parcel of land, and allowing paying customers to operate motorized amusement vehicles on the racetrack supported above the other park facility to thereby generate revenue. FIGS. 1 and 4 illustrate an elevated racetrack operated in such manner above another park activity, for example, a building or a water ride separate from the racetrack.

The method also includes constructing the racetrack with a generally non-circular portion of the racetrack extending away from the concentric circles and into a second parcel of land adjacent the first parcel, and installing customer ingress and egress facilities in the second parcel. Additionally, the method comprises constructing the racetrack with a generally non-circular portion of the racetrack extending away from the concentric circles, and installing customer ingress and egress facilities in the non-circular portion.

Other aspects of the method includes constructing the plurality of tiers of the racetrack in the airspace above a stormwater retention basin on the parcel of land, so that the motorized amusement vehicle track is operated at least in part above the stormwater retention pond. Great commercial utility for this invention is found in producing revenue from land having a stormwater retention area thereon, by constructing and operating the motorized amusement vehicle ride above the stormwater retention area or pond 36, as shown in FIG. 4. The invention embodied in this method allows generating income from this otherwise unproductive parcel of land. Environmental regulations are such that stormwater retention ponds are now usually required for commercial building projects to help prevent direct discharge of pollutants into local streams and lakes. The project developer is thus faced with having to reserve part of the available land for use as the stormwater retention pond, which completely restricts the use of that land, decreasing available revenue from the property. A working installation of this invention has obtained required environmental permits and is successfully operating directly over such a stormwater retention area, thereby creating additional income for the owner of the property. This arrangement is best illustrated in FIG. 4. This method could be employed anywhere there is a stormwater retention area on commercially zoned property, and could be a particularly profitable addition to a mall or large shopping center.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An elevated racetrack comprising:

a wooden support surface comprising a plurality of floor boards laid flat to form at least one straightaway, and at least one banked curve;

a concrete racetrack surface comprising an elastomeric membrane overlying said wooden support surface, a plurality of angle members securing said elastomeric membrane to the wooden support surface, and a predetermined layer of concrete overlying said elastomeric membrane and extending along the width of the wooden support surface; and a racetrack support frame comprising a plurality of wooden support posts sunk into suitable land to a depth sufficient to permanently anchor the support frame to the land and a plurality of support members connected thereto for supporting said wooden support surface and concrete racetrack surface above ground.

2. The racetrack of claim 1, wherein said concrete racetrack surface further comprises an additive material effective for increasing strength of the concrete.

3. The racetrack of claim 2, wherein said additive material is selected from welded wire and rebar.

4. The racetrack of claim 1, wherein said concrete racetrack surface further comprises an additive material effective for increasing resiliency of the concrete.

5. The racetrack of claim 4, wherein said additive material is selected from glass fibers and rubber chips.

6. The racetrack of claim 1, wherein each individual floor board of the plurality of floor boards has two lengthwise, substantially parallel, spaced apart sides and wherein a first individual floor board of the plurality abuts at least one other individual board of the plurality of floor boards so that said two substantially parallel, spaced apart sides of said first individual floor board are substantially parallel to said two substantially parallel, spaced apart sides of said at least one other individual floor board.

7. The racetrack of claim 1, in combination with at least one motorized amusement vehicle on said concrete racetrack surface.

8. The racetrack of claim 1, further including a shock absorbing guard rail positioned along an outer periphery of said concrete racetrack surface.

9. The racetrack of claim 8, wherein said shock absorbing guard rail further comprises aircraft tires.

10. The racetrack of claim 1, further comprising a safety fence positioned along an outer periphery of said wooden support surface to help prevent an amusement vehicle from leaving the racetrack surface.

11. The racetrack of claim 10, wherein said safety fence further comprises a plurality of safety wires connected to said support posts.

12. The racetrack of claim 1, wherein said racetrack surface includes at least one arched bridge section forming an overpass above at least a portion of said wooden support surface.

13. The racetrack of claim 1, wherein said racetrack support frame further includes at least one laminated support beam and at least one laminated stringer comprising a plurality of wooden boards connected to each other so as to form said laminated support beam and said laminated support stringer, said laminated support beam and said laminated support stringer positioned connected to and underlying said wooden support surface.

14. The racetrack of claim 1, wherein said at least one banked curve is banked at an angle selected from approximately 10 to 45 degrees.

15. The racetrack of claim 1, wherein said suitable land is selected from land having thereon a stormwater retention basin, a pond, a lake, and a wetland.

* * * * *